United States Patent [19]

Goodrich

[11] 3,958,749

[45] May 25, 1976

[54] GUSSETED PINCH BOTTOM BREAKAWAY POUCH BAG

[75] Inventor: John J. Goodrich, Pensacola, Fla.

[73] Assignee: St. Regis Paper Company, New York, N.Y.

[22] Filed: Sept. 2, 1975

[21] Appl. No.: 609,521

Related U.S. Application Data

[63] Continuation-in-part of Ser. No. 460,497, April 12, 1974, Pat. No. 3,910,488, which is a continuation-in-part of Ser. No. 235,908, March 20, 1972, Pat. No. 3,807,626.

[52] U.S. Cl. ..... 229/55; 229/62; 229/66

[51] Int. Cl.[2] ..... B65D 33/02

[58] Field of Search ..... 229/66, 14 B, 56, 55, 229/62; 206/484, 219, 222; 150/1, 3

[56] References Cited

UNITED STATES PATENTS

| | | | |
|---|---|---|---|
| 2,631,630 | 3/1953 | Brady et al. | 150/1 |
| 3,038,651 | 6/1962 | Cloudsley | 229/66 X |
| 3,114,643 | 12/1963 | Boston et al. | 229/66 X |
| 3,386,604 | 6/1968 | Fields | 229/66 X |
| 3,485,281 | 12/1969 | Wicks | 150/1 |
| 3,640,381 | 2/1972 | Kaneda et al. | 229/66 X |
| 3,807,626 | 4/1974 | Goodrich | 229/55 |
| 3,910,488 | 10/1975 | Goodrich | 229/66 X |

*Primary Examiner*—Stephen P. Garbe
*Attorney, Agent, or Firm*—Cooper, Dunham, Clark, Griffin & Moran

[57] ABSTRACT

The invention comprises a multiwall bag for the sift proof, leak proof and sanitary packaging of particulate and also of moisture containing materials, and also a package thereof, adapted for the subsequent uncontaminated withdrawal of the packaged product, the bag consisting essentially in combination of: a pair of inner and outer tubes of, respectively, heat sealable and non-heat sealable, flexible sheet materials; the outer tube consisting preferably of one or more contiguous plies bonded together at the opposite ends thereof, the bag in its assembled condition being open at one end and closed at the other end, the inner tube being heat sealed to closure adjacent the closed end and being lightly bonded thereat to the outer tube, and the outer tube being closed at the end beyond at least a portion of the heat sealed closure of the inner tube and by means for opening the same leaving the inner tube intact; the inner tube being lightly bonded to the outer tube at the open bag end and being peripherally perforated at spaced intervals below or within the bond; the open end of the bag being adapted for closure subsequent to filling, by heat sealing the inner tube to closure below the perforations and thence closing in both the tubes above the perforations, whereby upon subsequent opening of the outer tube at the closed bag end the inner tube may be manually withdrawn intact from the outer tube with its completely sealed in packaged contents by tensional severance thereof along the peripheral perforations.

12 Claims, 19 Drawing Figures

Fig. 2.
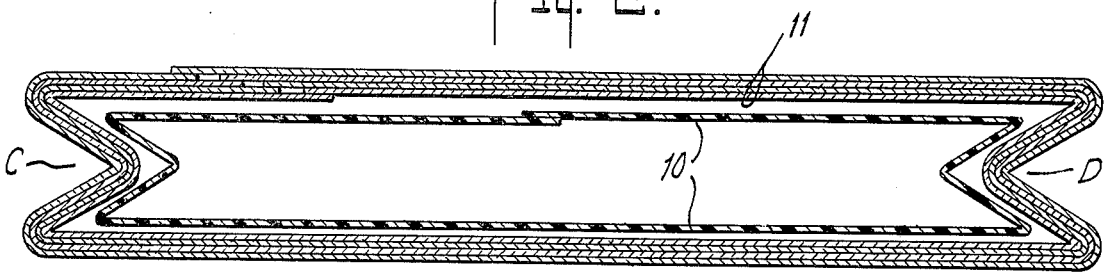
Fig. 4.
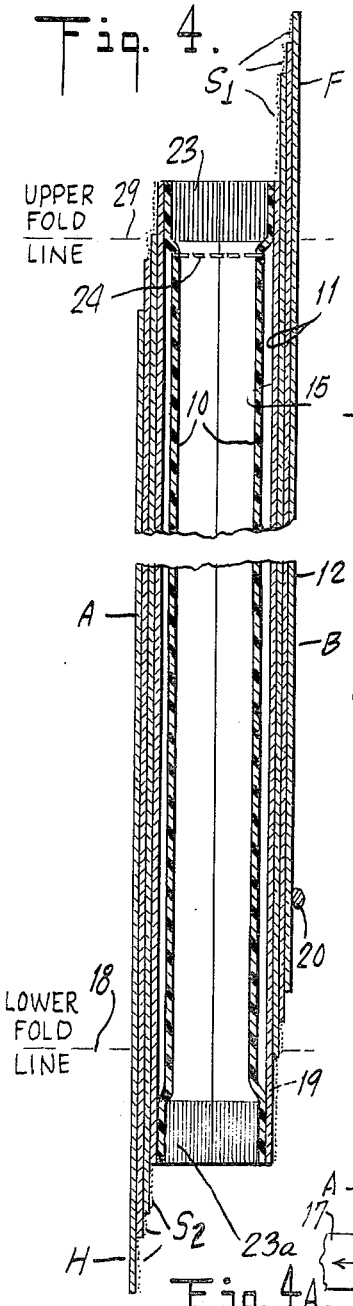
Fig. 3.
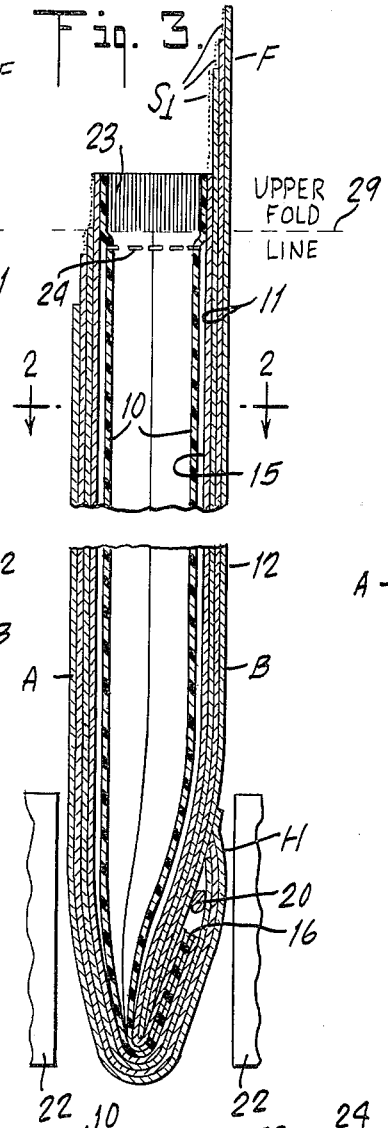
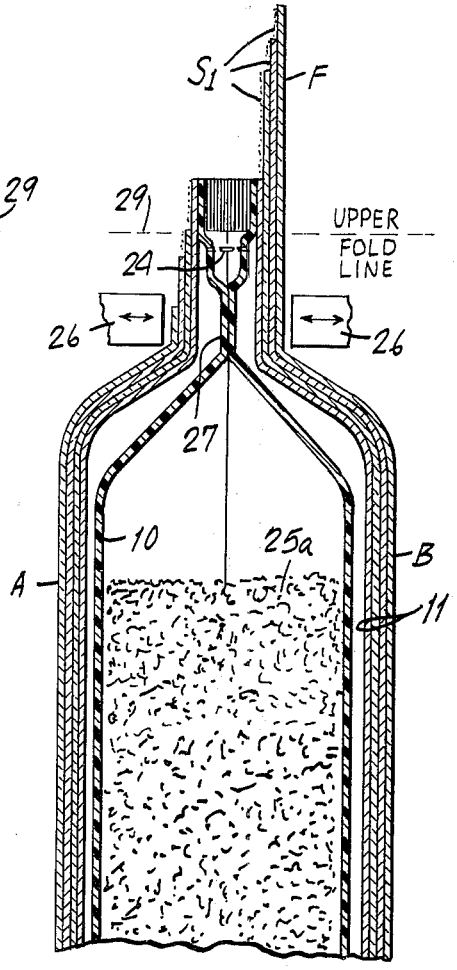
Fig. 7.
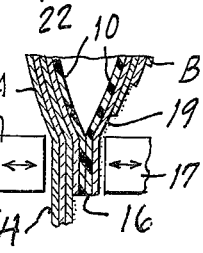
Fig. 4A.
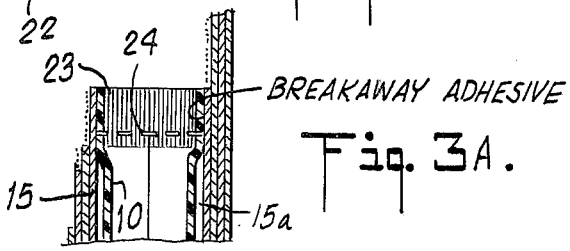
Fig. 3A.

Fig. 9A.
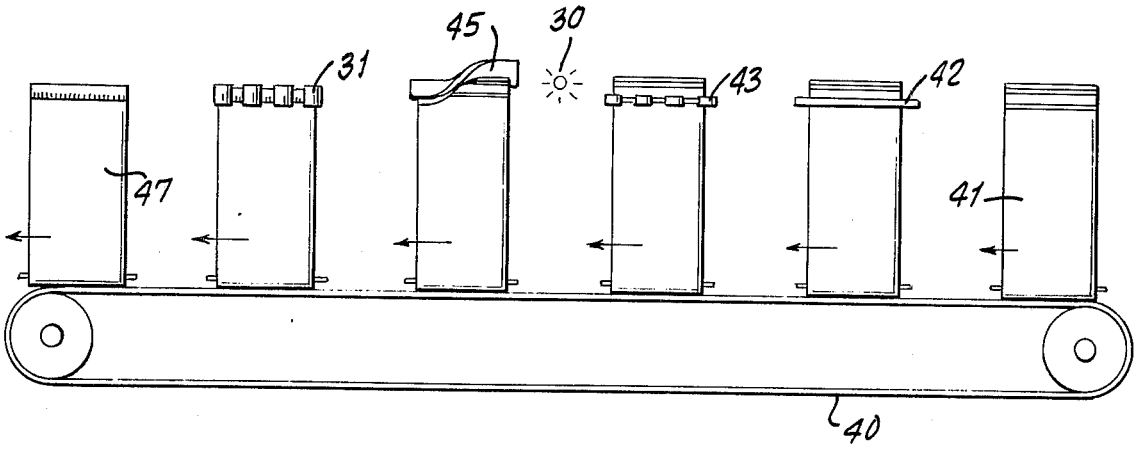
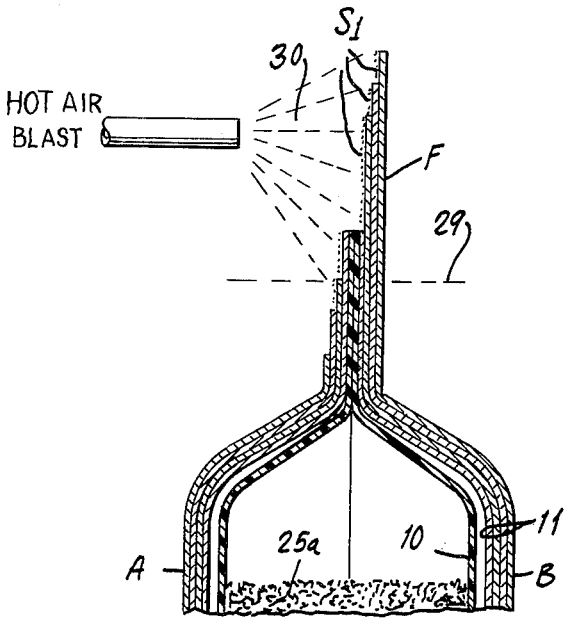
Fig. 8.
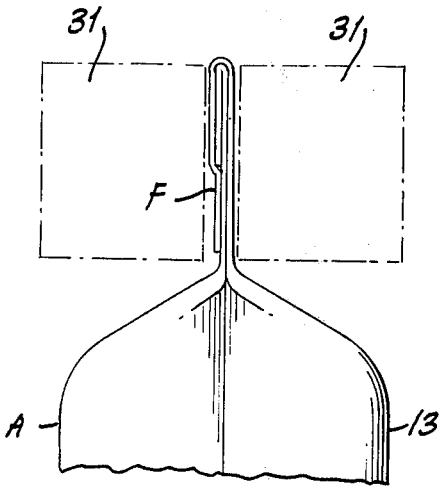
Fig. 9.

Fig. 10.
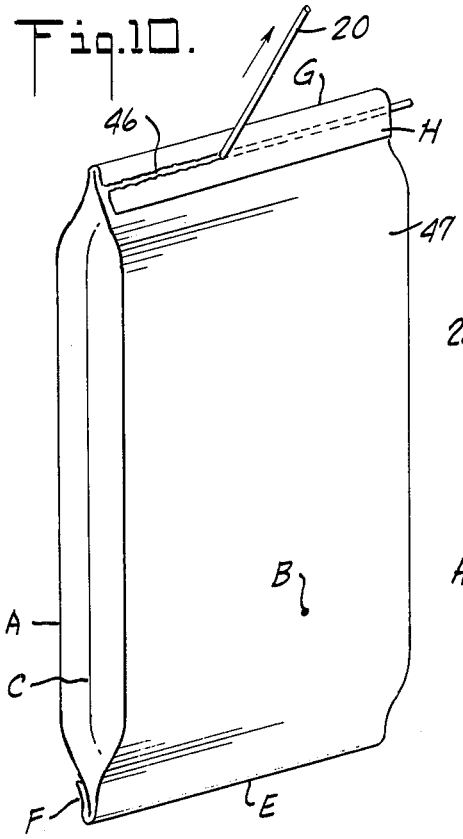
Fig. 11.
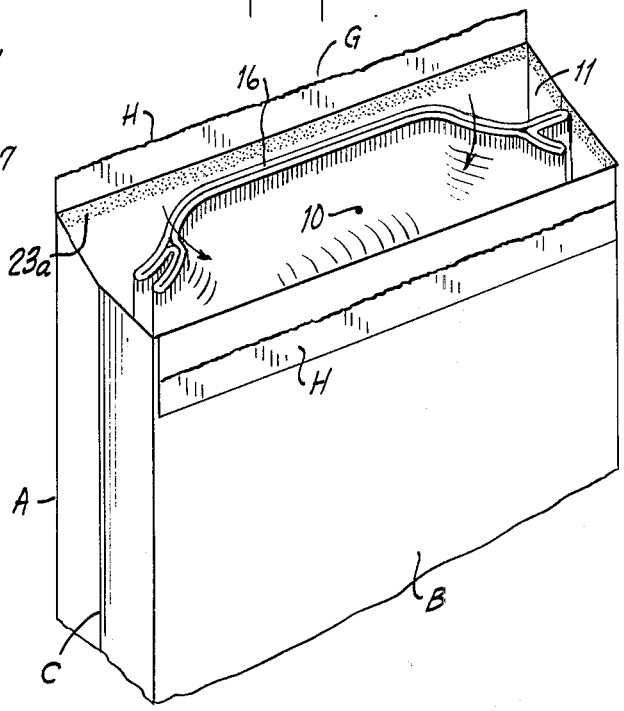
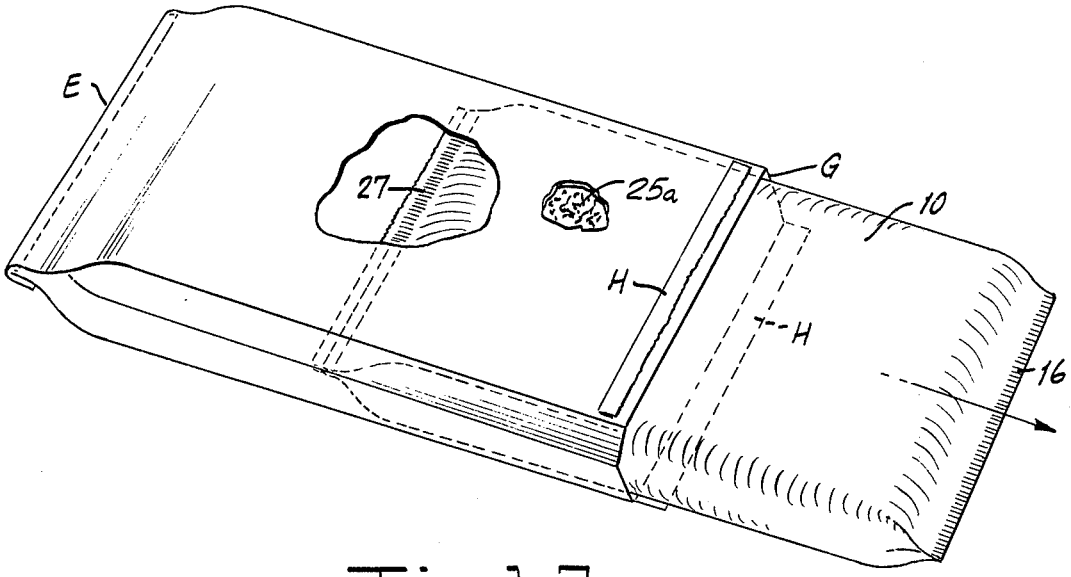
Fig. 12.

GUSSETED PINCH BOTTOM BREAKAWAY POUCH BAG

This application is a continuation-in-part of my copending application Ser. No. 460,497, filed Apr. 12, 1974 (now U.S. Pat. No. 3,910,488), which is in turn a continuation-in-part of my application Ser. No. 235,908, filed Mar. 20, 1972 (now U.S. Pat. No. 3,807,626).

In my U.S. Pat. No. 3,807,626 I have disclosed and claimed a so called "Gusseted Pinch Bottom Breakaway Pouch Bag" comprising a multiwall bag consisting of an inner tube of a heat sealable plastic material, such for example as polyethylene, and an outer tube consisting of one or more plies of a non-heat sealable material, usually of paper, although other flexible sheet materials may be employed therefor. The inner plastic ply is lightly bonded adjacent its opposite ends to the inner wall or contiguous ply of the outer tube for manual detachment therefrom. This bag in its assembled condition as manufactured is open at one end and closed at the other end and is formed with a pair of oppositely disposed gussets interposed between oppositely disposed walls, one of which extends beyond and overlaps the other at each bag end, the plastic ply being heat sealed to closure adjacent the closed end, terminal portions of all plies thereat are folded over with the heat sealed end of the plastic ply and the overlap portion thereat sealed against the opposite bag wall. At the open bag end the plastic tube after filling, usually with a bulk particulate product, is heat sealed to closure and the overlap portion of the outer tube thereat, also folded over said heat sealed end of the inner tube and said overlap portion sealed against the opposite bag wall. The bag as thus sealed closed at both ends with the packaged material disposed within the plastic tube and sealed therein by the heat sealed closures thereof at both ends, may thereafter be recovered from the outer tube by stripping away the outer tube or all plies thereof leaving the inner or plastic tube intact with its therein packaged product sealed therein.

The present invention provides multiwall bags of improved constructions as compared to that of my patent aforesaid, in that a plastic inner tube heat sealed at one end and manufactured integral with an outer tube housing the same and also closed at said end, may, after filling with a packaged product, be heat sealed at the opposite end and closure of said outer tube at said end, be withdrawn intact with its packaged content from said outer tube upon opening said outer tube at its initially closed end, and while also leaving said outer tube substantially intact for reuse.

This unique action of the present invention is achieved by the novel and unique construction of the bag of the present invention as follows. The present invention comprises a multiwall bag for the sift proof, leak proof, odor retentive and sanitary packaging of a bulk product, and for the subsequent uncontaminated withdrawal of the packaged product, which consists essentially in combination of: a pair of inner and outer tubes of, respectively, heat sealable and non-heat sealable, flexible sheet materials, the bag in its assembled condition being open at one end and closed at the other end, the inner tube being heat sealed to closure adjacent said closed end and being lightly bonded to said outer tube thereat for manual detachment therefrom and said outer tube being closed at said end beyond said heat sealed closure of said inner tube, by means for opening the same while leaving said inner tube intact, the inner tube being bonded to the outer tube at the open bag end over a terminal zone of each, and being peripherally perforated at spaced intervals below or within said bond zone, as hereinafter described, the open end of said bag being adapted for closure subsequent to filling, by heat sealing said inner tube to closure below said perforations and thence closed in both said tubes above said perforations, whereby upon subsequent opening of said outer tube at said initially closed bag end, said inner tube may be manually withdrawn intact from said outer tube with its completely sealed in packaged contents, by tensional severance of said inner tube along said peripheral perforations, thereby also leaving said outer tube intact or substantially intact for reuse.

The invention may be embodied in two-ply bags consisting of an inner tube of a heat sealable material and a single outer tube of a non-heat sealable material, such as paper, or the outer tube may comprise a plurality of contiguous plies bonded together at the opposite ends thereof. The invention may be embodied in bags which are closed at both ends by sewing, or in bags in which the end closures are produced by folding over each end and adhesively bonding to the opposite bag wall. The invention is also applicable to gusseted as well as to non-gusseted bags of either of the above end closure constructions, all as exemplified in the ensuring more detailed description thereof had with reference to the accompanying drawings wherein:

FIG. 1 is a perspective view of a gusseted multiwall, pinch bottom, open mouth bag according to one embodiment of the invention, while FIGS. 2 and 3 are transverse and longitudinal sectional views thereof as taken at 2—2 and 3—3 of FIG. 1.

FIG. 3A is a fragmentary view of the upper end of FIG. 3, showing a modification thereof as explained below.

FIG. 4 is a view like FIG. 3 of the bag thereof prior to effecting the bottom closure.

FIG. 4A is a fragmentary view of the lower end of FIG. 4, illustrating the heat sealing to closure of the inner ply or tube thereat, prior to effecting the end closure of the outer tube thereof, the latter as shown in FIG. 3.

FIG. 7 is a longitudinal sectional view of the upper end of the bag of FIGS. 1–6 inc. as filled with a particulate bulk product and illustrative of the step of heat sealing the inner ply or tube to closure at the open bag end prior to closure at said end of the outer tube; while FIGS. 8 and 9 are similar views which illustrate the subsequent closure of the outer tube at said end.

FIG. 9A is a schematic view in elevation, illustrative of a mechanism for automatically closing the open end of the filled bags in sequence as delivered onto a travelling belt.

FIGS. 10 to 12 inc., are perspective views illustrative of the steps of subsequent opening the filled bag and of manually withdrawing intact the filled plastic inner tube therefrom as heat sealed at both ends to seal the packaged product therein, FIG. 10 illustrating the opening of the outer bag tube at the initially closed bag end by action of a tear cord, wherein as illustrated in FIG. 11, the bag is completely opened in the outer tube at said end to expose the heat sealed inner ply contaning the packaged product, and whereby as illustrated in FIG. 12, the heat sealed inner tube may be manually withdrawn intact from the outer tube by tensional severance of the inner tube at said perforations.

Figure 13:
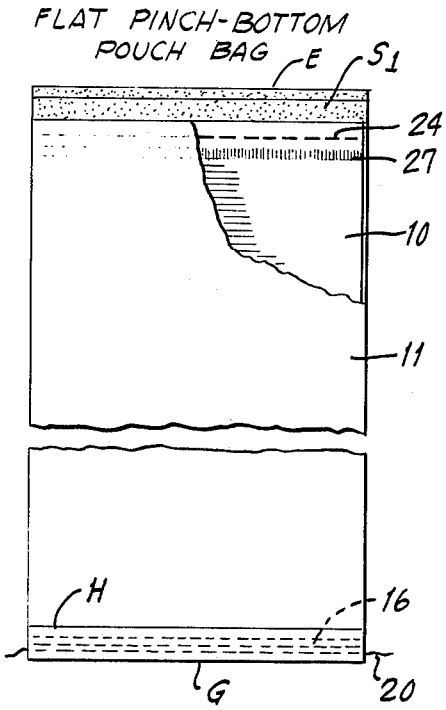

FIG. 13 is a plan view of a non-gusseted, pinch bottom, open mouth bag of the invention with parts broken away to show the open end structure.

Figure 15:
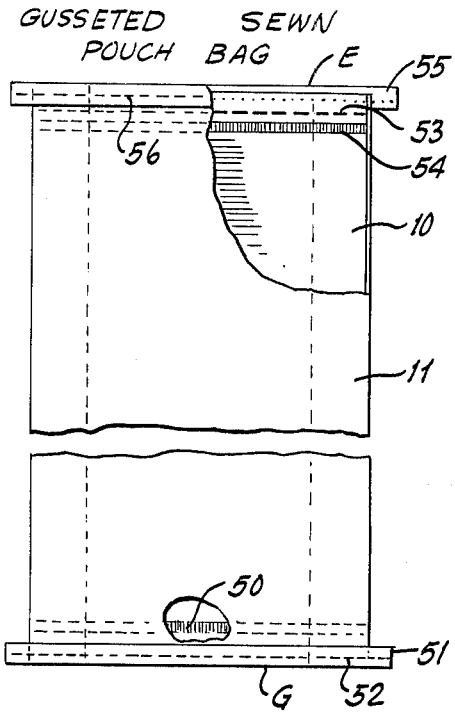
Figure 14:
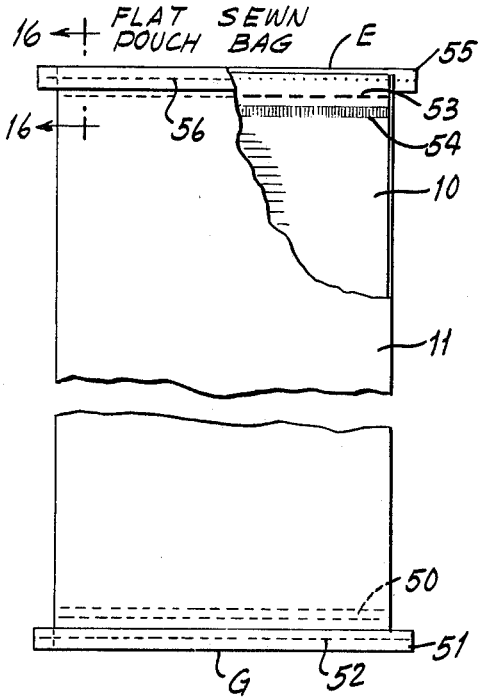
Figure 16:
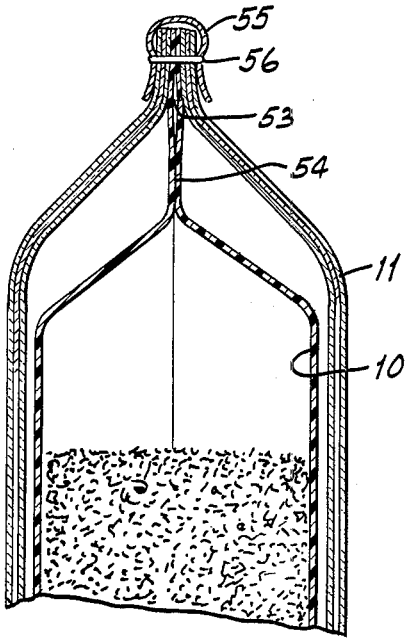

FIGS. 14 and 15 are plan views of non-gusseted and gusseted, sewn end bags according to the invention. FIG. 16 is a longitudinal sectional view of each of the bags of FIGS. 14 and 15 inc., as filled with a bulk product, and illustrative of the closures at the bag ends inclusive of the heat seal closures of the inner tube and the sewn seam closures of the outer tube.

Figure 1:
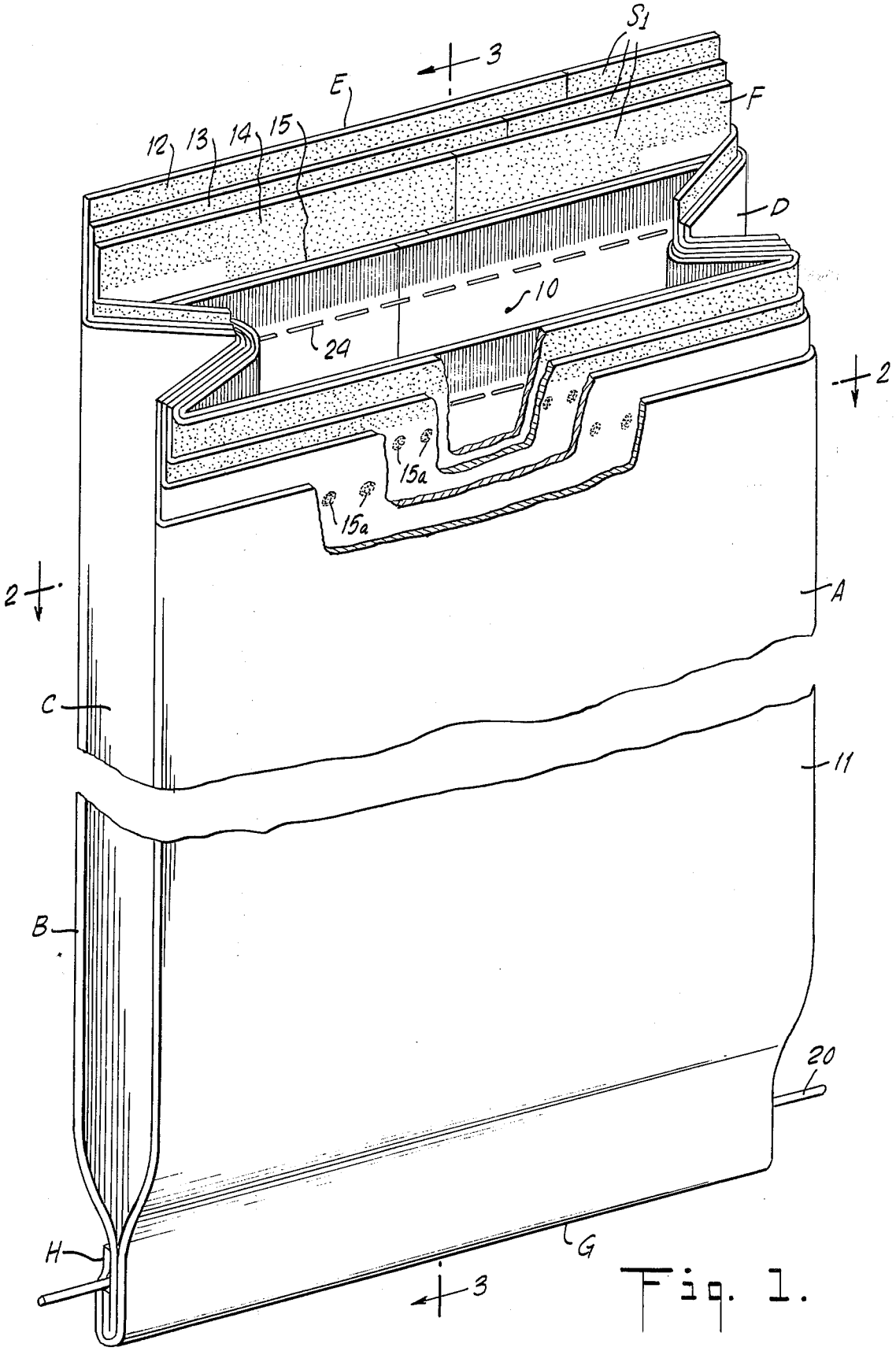
Figure 5:
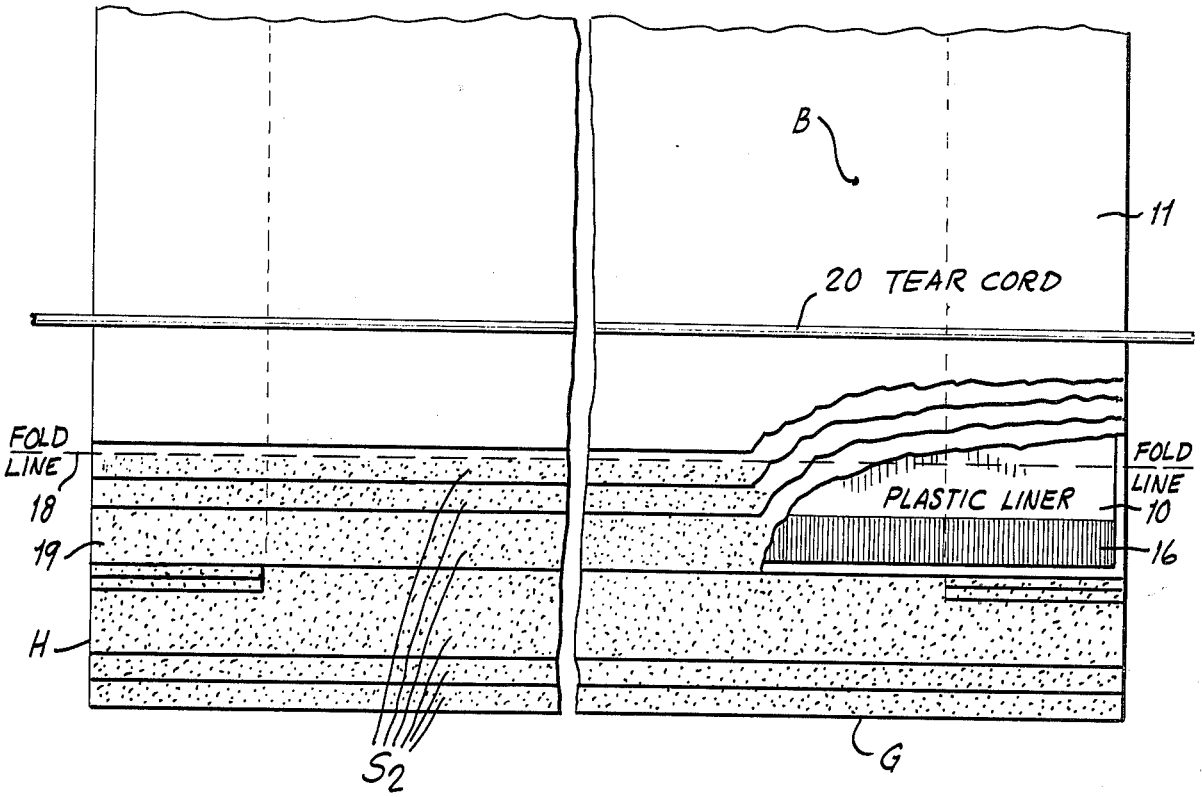
FIGS. 5 and 6 are enlarged plan views of the closed bag end prior to and subsequent to end closure thereof, respectively.
Figure 6:
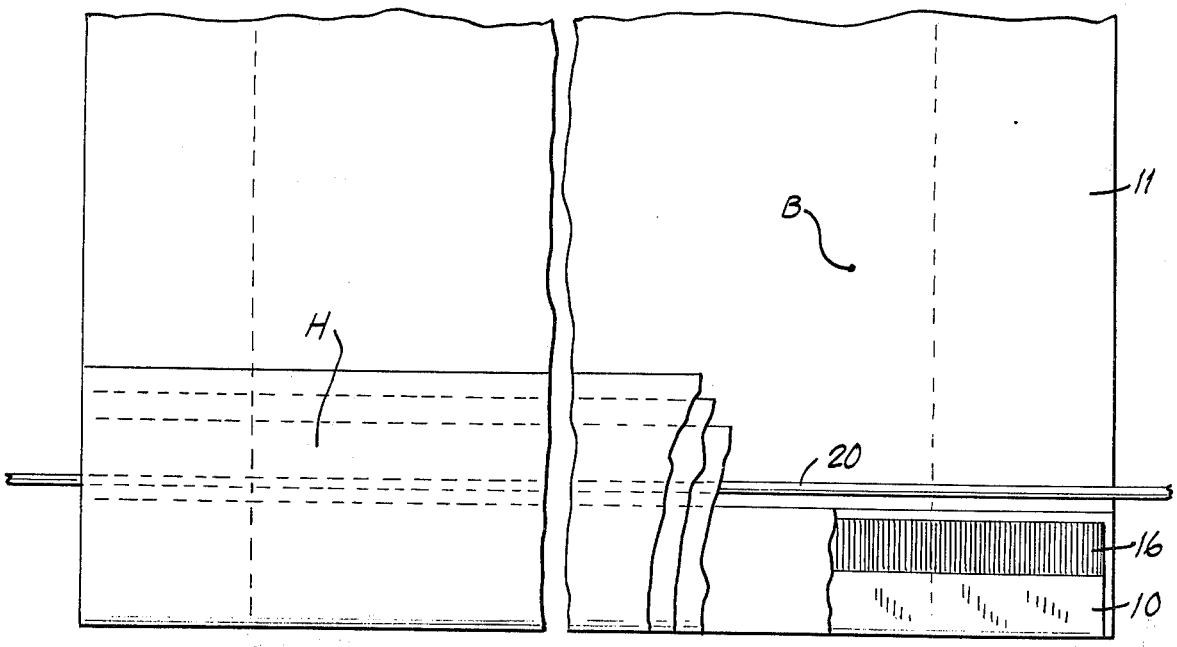

Referring to the embodiment of the invention shown in FIGS. 1–6 inc., it comprises a multiwall, pinch bottom, open mouth bag having in its assembled condition as manufactured, front and rear walls A and B, between which are interposed a pair of oppositely disposed gussets C and D, wherein at the upper or open bag end E, the rear wall B extends above and overlaps the front wall A as at F, the lower or closed bag end G, FIGS. 1, 5 and 6, being the reverse of said open end, the overlap front wall portion H thereat being folded over with a terminal portion of the rear wall and sealed against the rear wall as explained more fully below and as shown in FIGS. 3 and 6.

The bag comprises an inner tube 10 of a heat sealable plastic material, such as polyethylene, and an outer tube 11, consisting of four, respectively, contiguous plies 12–15 inc., of a non-heat sealable material, such for example as paper. These outer plies are spot pasted to one another at the opposite bag ends as at 15*a*, FIG. 1, and are preferably stepped in the front and back walls at the bag ends thereat as illustrated in FIGS. 1 and 5, to facilitate end closures of the outer tube as explained below. Also for purposes of closing the outer tube at the open end, exposed terminal portions thereof are coated, as shown by the stippling $S_1$ with a hot melt adhesive in a dormant state, such as a thermoplastic resin adhesive, which at the time of closure is heat reactivated.

Referring to FIGS. 1–4, the upper end of the inner tube 10 is lightly bonded to the contiguous ply 15 of the outer tube 11, over a zone as at 23, and at a short distance below this bond, the inner tube is peripherally perforated, as at 24. Alternatively, where the packaged product is a finely comminuted material, such as powdered milk, flour, etc., the line of perforations 24, is disposed within the bonded zone 23, at the upper bag end, in the manner shown in FIG. 3A, wherein the perforations 24, are disposed within the bonded area 23. This prevents such finely powdered product from sifting through the perforations into the space between tube 10 and the contiguous ply 15, as at 15*a*, FIG. 3A. In addition referring to FIG. 4, the inner tube 10 is also lightly bonded to said contiguous ply 15 of said outer tube, at the lower end thereof, as at 23*a*, for manual detachment therefrom. For purposes of these light bondings, a pressure sensitive or non-hardening latex adhesive may be employed.

Also at the lower bag end G, the inner tube 10 is transversely heat sealed to closure at its lower end, as at 16, FIG. 4A and 6, as by heat sealing between heated pressure bars 17, FIG. 4A. The outer tube 11 is thereafter closed at the lower bag end by folding the front wall overlap portion H thereat, about a fold line 18, together with a terminal portion 19, of the rear wall B, and the heat sealed end 16, of the inner tube 10, and sealing said overlap portion H against the rear bag wall B beyond the heat sealed terminus 16 of the inner tube, as shown in FIG. 3. For purposes of this lower end closure, the exposed terminal portions of the outer tube are coated just prior to closure with the aforesaid hot melt adhesive in a hot liquid state, over the portions indicated by the stippling $S_2$, FIG. 5, and the end closure thence completed by folding over and sealing as in FIGS. 3 and 6.

To facilitate subsequent opening of the outer tube 11, at the closed or lower end of the bag, a tear cord 20, is interposed in process of manufacture and in the manner shown in FIG. 3, between the rear wall B and said overlap front wall portion H, beyond the heat sealed terminus 16 of the inner tube. Thus when the outer tube 11 is subsequently opened at the closed end by means of the tear cord 20, the inner tube 10 will be free at said end for withdrawal as explained more in detail below.

The bag in its assembled condition as thus shown in FIGS. 1–3 inc., is thus ready for filling through the upper or open bag end with a product to be packaged, which usually takes the form of a particulate bulk product such as is shown at 25*a* in the filled bag of FIG. 7. The bag as thus filled is now closed at the open bag end by first heat sealing the inner tube 10 to closure below the line of perforations 24, as by gripping the bag end thereat between hot pressure bars 26, FIG. 7, to heat seal to closure the inner tube, as at 27.

Closure of the outer tube 11 at the open bag end is next accomplished by heat reactivating the hot melt adhesive $S_1$ by means of a hot air blast 30, FIG. 8, and thence folding over the outer tube along the fold line 29 against the front wall A and passing between pressure rolls 31, FIG. 9 to complete the seal.

Referring to FIG. 9A, a series of such filled bags may be rapidly closed in sequence by the mechanism shown diagramatically therein. The filled bags are successively placed on one end of an endless belt 40, as at 41, which transports the bag between a pair of oppositely disposed pressure bars, as at 42, which squeeze the open bag end to closure. The bag is fed thence between opposed pairs of hot pressure rollers 43, which heat seal the inner tube to closure as at 27, FIG. 7. The bag passes thence past a hot air blast 30, which reactivates the preapplied hot melt adhesives $S_1$, applied to the exposed upper portion of the bag. The bag passes thence under a folding device 45, which folds over the upper bag end, and passes thence between opposed pressure rolls, as at 31, which seals closed the upper end of the outer bag tube 11, the fully closed bag being delivered thence as at 47 to the discharge end of belt 47.

Referring now to FIGS. 10–12 inc. the filled and completely closed bag 47, FIG. 10, may now be opened at the initially closed bag end G, by actuation of the tear cord 20 to tear open the outer tube overlap portion H, as at 46, thereby to free the upper heat sealed end 16 of the inner tube 10, by manually loosening the bond thereat, 23a, FIG. 4, at said end between the inner tube 10 and the contiguous outer ply as shown in FIG. 11, whereupon the inner tube 10, may be manually withdrawn from the outer tube 11 by pulling on the inner tube 10 to sever the same at the line of perforations 24, FIGS. 1 and 3, or FIG. 3A, whereby the inner tube 10 is withdrawn intact from the outer tube 11, with its completely sealed in packaged contents 25*a*, in the manner illustrated in FIG. 12, and also without impairing the outer tube except for the tear 46 of the overlapped portion H. The outer tube may thus be reused by trimming the open end G and closing thereat subsequent to filling with a packaged product with a sewn end closure.

Referring now to FIG. 13, the non-gusseted, pinch bottom, pouch bag thereof is constructed and closed at the open end after filling in the same manner as the gusseted bag of FIGS. 1–3 inc., except for omission of the gussets, like elements thereof being similarly designated.

Referring to the sewn end, non-gusseted and gusseted bags of FIGS. 14 and 15, in these bags as manufactured, the plastic inner tube 10, is heat sealed to closure at the closed end G, and as at 50, prior to closing said end of the outer tube 11, by facing with tape, as at 51, and stitching closed as at 52, below the heat seal 50. At the open bag end E, the inner tube 10 is perforated as at 53, and the closure effected at this end by first heat sealing the inner tube to closure as at 54, FIGS. 14–16, and the closure of the outer tube thence completed by facing with tape as at 55, and stitching closed as at 56 above the perforations 53. At the closed bag end a chain stitch 52 is preferably employed, whereby the outer tube at this end may be opened by pulling thereon to unravel the stitch whereby the inner tube 10 may be withdrawn intact from the outer tube, which also remains intact for reuse.

Reverting to the multiwall pinch bottom embodiment of the invention shown and described with reference to FIGS. 1–9 inc., other modifications of the ply stepping shown at the bag ends may be employed without departing from the spirit of the invention. Thus referring to FIG. 1, both the front and rear gusset panels may be successively stepped up with respect to the front wall, and also some or all of the gusset plies may be stepped up one beyond the other in the front or rear gusset panels or both. Also in such bags having a large number of plies only some of the plies would need to be stepped in the front and back walls, and the same would apply to the non-gusseted bag of FIG. 13.

All such embodiments of the invention may be produced in conventional stepped end tuber and bottomer units by feeding the plies as webs from rolls individual thereto and in laterally offset staggered relation, to perforating units for transversely perforating the webs at bag lengths in accordance with a desired ply and/or gusset steps at the bag ends, and also in the plastic ply; thence through units for bonding the plies together at the bag ends as at 15*a*, FIG. 1 and as at 23 and 23*a*, FIGS. 3 or 4. The webs as thus consolidated are fed thence through a tuber for forming into a continuous tube with the opposed longitudinal edges of the respective webs overlapped and individually bonded each to itself. The consolidated web is fed thence through the snapper unit for separating the same into bag blanks at the transverse end perforations of the individual plies for producing the selected end stepping of each ply. The bag blanks are fed thence through a heat sealing unit for heat sealing the plastic ply at bag lengths as at 16, FIG. 4A, and thence through the bottomer unit for effecting the end bottom closure as shown in FIG. 3, and with the tear cord 20 inserted at this stage.

As regards the sewn end bags of FIGS. 14–15, they may be similarly produced except for omission of ply stepping at the bag ends, such bags being usually flush cut in all plies at the bag ends. End closures are produced on a conventional sewing unit for closing the bag ends.

What is claimed is:

1. A multiwall bag for the sift proof, leak proof and sanitary packaging of particulate and also of moisture containing materials, and for the subsequent uncontaminated withdrawal of the packaged product, said bag consisting essentially in combination of: a pair of inner and outer tubes of, respectively, heat sealable and non-heat sealable, flexible sheet materials; said bag in its assembled condition being open at one end and closed at the other end, said inner tube being lightly bonded to said outer tube at said closed end for manual detachment therefrom, and being heat sealed to closure adjacent said closed end, said outer tube being closed at said end beyond at least a portion of said heat sealed closure of said inner tube, by means for opening the same leaving said inner tube intact; said inner tube being bonded to said outer tube at the open bag end and being peripherally perforated at spaced intervals adjacent said end, the open end of said bag being adapted for closure subsequent to filling, by heat sealing said inner tube to closure below said perforations and thence closed in both said tubes above said perforations, whereby upon subsequent opening of said outer tube at said closed bag end said inner tube may be manually withdrawn intact from said outer tube with its completely sealed in packaged contents by tensional severance thereof along said peripheral perforations.

2. A bag according to claim 1 in which said outer tube is composed of a plurality of respectively contiguous plies bonded together at the opposite ends of said tube, whereby said end closures of said outer tube have the combined integrated strength of all said plies.

3. A multiwall bag for the sift proof, leak proof and sanitary packaging of particulate and also of moisture containing materials, and for the subsequent uncontaminated withdrawal of the packaged product, said bag consisting essentially in combination of: a pair of inner and outer tubes of, respectively, heat sealable and non-heat sealable, flexible sheet materials: said bag in its assembled condition being open at one end and closed at the other end; said inner tube being lightly bonded to said outer tube at said closed end for manual detachment therefrom, and being heat sealed to closure adjacent said closed end, said outer tube being chainstitched-closed below at least a portion of said inner tube heat seal, for easily opening said outer tube leaving said inner tube intact, said inner tube being bonded to said outer tube at the open bag end and being peripherally perforated at spaced intervals adjacent said end; the open end of said bag being adapted to closed subsequent to filling, by heat sealing said inner tube to closure below said perforations and thence by stitching closed in both said tubes above said perforations, whereby upon subsequent manual unravelling of said chain stitch, at said closed bag end, said inner tube may be manually withdrawn intact from said outer tube with its completely sealed in packaged contents, by tensional severance thereof along said peripheral perforations.

4. A bag according to claim 3 in which said outer tube is composed of a plurality of respectively contiguous plies bonded together at the opposite ends of said tube, whereby said end closures of said outer tube have the combined integrated strength of all said plies.

5. A multiwall bag for the sift proof, leak proof and sanitary packaging of particulate and also of moisture containing materials, and for the subsequent uncontaminated withdrawal of the packaged product, said bag consisting essentially in combination of: a pair of inner and outer tubes of, respectively, heat sealable and non-heat sealable, flexible sheet materials, said bag in its assembled condition being open at one end and closed at the other end, and having at the open bag end a front wall and an oppositely disposed back wall which extends beyond and overlaps said front wall, and having at the closed end a wall configuration the reverse of that at said open end, said inner tube being lightly bonded to said outer tube at said closed end for manual detachment therefrom, and being heat sealed to closure adjacent said closed end, said outer tube being closed at said end by folded over terminal portions of both said tubes inclusive of all plies thereof and of said heat sealed portion of said inner tube and with said overlap front wall portion thereat sealed to the outer wall of said outer tube beyond the terminus of said inner tube, whereby said outer tube may be opened thereat, leaving said inner tube intact, said inner tube being bonded to said outer tube at the open bag end and being peripherally perforated at spaced intervals adjacent said end, the open end of said bag being adapted for closure subsequent to filling, by heat sealing said inner tube to closure below said perforations and thence closed in both said tubes by folding over terminal portions thereof above said perforations and sealing to the outer wall of said outer tube, whereby upon subsequent opening of said outer tube at said closed end, said inner tube may be manually withdrawn intact from said outer tube with its completely sealed in packaged contents by tensional severance thereof along said peripheral perforations.

6. A bag according to claim 5 in which said outer tube is composed of a plurality of respectively contiguous plies bonded together at the opposite ends of said tube, thereby to impart to said end closures of said outer tube the combined integrated strength of all said plies.

7. A bag according to claim 6 in which at least some of the plies of said outer tube are stepped one beyond another in said oppositely disposed walls at the ends of said outer tube, and wherein at the open bag end said stepped ply portion in said rear wall and said overlap rear wall portion are coated with a heat reactivatable adhesive in a dormant state for heat sealing said portions to said front wall.

8. A bag according to claim 5 having interposed between said front and back walls a pair of oppositely disposed gussets with at least portions of said gussets terminating within said overlap wall portions at said bag ends to provide exposed portions thereof at said open bag end, and said exposed gusset portions and said overlap rear wall portion thereat being coated with a heat reactivatable adhesive in a dormant state for heat sealing the same against said front wall.

9. A bag according to claim 8 wherein at least some of the plies of said outer tube are stepped one beyond another in said oppositely disposed walls at the opposite ends of said outer tube, and wherein at the open bag end said stepped rear wall plies, said exposed gusset portions, and said overlap rear wall portion are coated with a heat reactivatable adhesive in a dormant state for heat sealing said portions against said front wall.

10. A multiwall bag for the sift proof, leak proof and sanitary packaging of particulate and also of moisture containing materials, and for the subsequent uncontaminated withdrawal of the packaged product, said bag consisting essentially in combination of: a pair of inner and outer tubes of, respectively, heat sealable and non-heat sealable, flexible sheet materials; said bag in its assembled condition being open at one end and closed at the other end, and having at the open bag end a front wall and an oppositely disposed back wall which extends beyond and overlaps said front wall and having at the closed end a wall configuration the reverse of that at said open end, said inner tube being lightly bonded to said outer tube at said closed end for manual detachment therefrom and being heat sealed to closure adjacent said closed end, said outer tube being closed at said end by folded over terminal portions of both said tubes at said end inclusive of all plies thereof and of said heat sealed portion of said inner tube and with said overlap front wall portion thereat sealed to the outer wall of said tube beyond the terminus of said inner tube, and with a tear cord interposed between said outer tube wall and said overlap wall portion thereof beyond the terminus of said inner tube, whereby said outer tube may be manually opened thereat by means of said tear cord leaving said inner tube intact, said inner tube being bonded to said outer tube at the open bag end and being peripherally perforated at spaced intervals adjacent said end, the open end of said bag being adapted for closure subsequent to filling, by heat sealing said inner tube to closure below said perforations and thence closed in both said tubes by folding over terminal portions of both said tubes above said perforations and sealing to the outer wall of said outer tube, whereby upon subsequent opening of said outer tube at said closed end by means of said tear cord, said inner tube may be manually withdrawn intact from said outer tube with its completely sealed in packaged contents, by tensional severance thereof along said peripheral perforations.

11. A bag according to claim 10 in which said outer tube is composed of a plurality of plies bonded together at the opposite ends of said tube for enhancing the strength of the end closures thereof.

12. A sift proof and leak proof package of particulate material comprising a multiwall bag consisting essentially in combination of: a pair of inner and outer tubes of, respectively, heat sealable and non-heat sealable, flexible sheet materials, said inner tube being lightly bonded to said outer tube at one bag end for manual detachment therefrom, and being heat sealed to closure adjacent said bag end, and containing said particulate material, and said outer tube being closed below the heat seal of said inner tube at said end by means for opening the same leaving said inner tube intact; said inner tube being bonded to said outer tube at the opposite bag end and being peripherally perforated at spaced intervals adjacent said end; said inner tube being heat sealed to closure below said perforations adjacent said opposite bag end for sealing said particulate material therein, and both said tubes being closed thereat above said perforations, whereby upon opening of said outer tube at said closed end, said inner tube may be manually withdrawn intact from said outer tube with its completely sealed in particulate material content, by tensional severance of said inner tube from said outer tube at said outer tube at said perforated portions of said inner tube.

* * * * *